US008339280B1

(12) United States Patent
Sikora et al.

(10) Patent No.: US 8,339,280 B1
(45) Date of Patent: Dec. 25, 2012

(54) TRAFFIC PREEMPTION SYSTEM AND RELATED METHODS

(75) Inventors: Scott T. Sikora, Gilbert, AZ (US); David Gerard Worthy, Gilbert, AZ (US); Timothy A. Geiger, Gilbert, AZ (US)

(73) Assignee: Tomar Electronics, Inc., Gilbert, AZ (US)

( * ) Notice: Subject to any disclaimer, the term of this patent is extended or adjusted under 35 U.S.C. 154(b) by 0 days.

(21) Appl. No.: 13/291,892

(22) Filed: Nov. 8, 2011

Related U.S. Application Data

(63) Continuation of application No. 12/390,042, filed on Feb. 20, 2009, now Pat. No. 8,054,202.

(51) Int. Cl.
*G08G 1/07* (2006.01)

(52) U.S. Cl. ..... 340/906; 340/902; 340/904; 340/905; 340/907; 340/933

(58) Field of Classification Search ..... 340/902, 340/904, 905, 906, 907, 933
See application file for complete search history.

(56) References Cited

U.S. PATENT DOCUMENTS 5,172,113 A 12/1992 Hamer
5,202,683 A * 4/1993 Hamer et al. ..... 340/906
5,986,575 A 11/1999 Jones et al.
6,243,026 B1 6/2001 Jones et al.
8,054,202 B1 * 11/2011 Sikora et al. ..... 340/906
2006/0273923 A1 12/2006 Schwartz
2006/0273924 A1 12/2006 Schwartz
2006/0273925 A1 12/2006 Schwartz
2006/0273926 A1 12/2006 Schwartz
2007/0008173 A1 1/2007 Schwartz
2007/0008174 A1 * 1/2007 Schwartz ..... 340/902
2010/0033347 A1 * 2/2010 Hayashi ..... 340/905

* cited by examiner

*Primary Examiner* — Daryl Pope
(74) *Attorney, Agent, or Firm* — Booth Udall, PLC

(57) ABSTRACT

A traffic preemption system and related methods. Implementations may include a vehicle preemption unit mounted to a vehicle including an optical transmitter adapted to identify to an intersection preemption unit coupled with an intersection system controller the presence of the vehicle. The vehicle preemption unit may include a vehicle radio transceiver and the optical transmitter and the vehicle radio transceiver may be coupled with a vehicle controller. The intersection preemption unit may include an optical receiver and an intersection radio transceiver. The optical receiver and the intersection radio transceiver may each be coupled with an intersection controller. The intersection preemption unit may be adapted to change a traffic light in favor of the vehicle to which the vehicle preemption unit is mounted in response to an optical signal, a radio signal, or a combination of optical and radio signals from the vehicle preemption unit.

21 Claims, 10 Drawing Sheets

TRAFFIC PREEMPTION SYSTEM AND RELATED METHODS

CROSS REFERENCE TO RELATED APPLICATIONS

This application is a continuation application of U.S. patent application Ser. No. 12/390,042 to Sikora entitled "Traffic Preemption System and Related Methods," which was filed on Feb. 20, 2009, now pending, the disclosure of which is hereby incorporated herein by reference.

BACKGROUND

1. Technical Field

Aspects of this document relate generally to traffic preemption systems.

2. Background Art

Traffic preemption systems are conventionally used to permit emergency and other vehicles to change a traffic light initially red at an intersection to green prior to their arrival. With the light in the vehicle's favor, the vehicle does not need to wait or to drive on the wrong side of the street to avoid stopped vehicles at the light. In addition, conventional traffic preemption systems have been used to aid public transportation vehicles, such as buses, to maintain headway relative to other vehicles during high traffic periods. Some conventional preemption systems also contain functionality that allows prioritization of the movement of an emergency vehicle over a public transportation vehicle through an intersection.

SUMMARY

Implementations of traffic preemption systems disclosed in this document may include a vehicle preemption unit mounted to a vehicle where the vehicle preemption unit includes an optical transmitter adapted to identify to an intersection preemption unit coupled with an intersection system controller the presence of the vehicle. The vehicle preemption unit may further include a vehicle radio transceiver adapted to communicate with the intersection preemption unit where the optical transmitter and the vehicle radio transceiver are each coupled with a vehicle controller adapted to process signals sent and received by the vehicle preemption unit. The intersection preemption unit may include an optical receiver adapted to receive an optical signal from the optical transmitter of the vehicle preemption unit and an intersection radio transceiver adapted to communicate with the vehicle radio transceiver of the vehicle preemption unit. The optical receiver and the intersection radio transceiver may each be coupled with an intersection controller adapted to process signals sent and received by the intersection preemption unit. The intersection preemption unit may be adapted to change a traffic light in favor of the vehicle to which the vehicle preemption unit is mounted in response to an optical signal, a radio signal, or a combination of optical and radio signals from the vehicle preemption unit.

Implementations of traffic preemption systems may include one, all, or any of the following:

The intersection preemption unit may further include a head mounted to a traffic light support fixture where the head includes the optical receiver and the intersection radio transceiver and where the head is coupled to the intersection controller via a wire.

The intersection preemption unit may further include a head mounted to a traffic light support fixture where the head includes the optical receiver and the intersection radio transceiver and where the head is coupled to the intersection controller via a wireless relay.

The intersection preemption unit may further include a head mounted to a traffic light support fixture where the head includes the optical receiver and the intersection radio transceiver and where the head is adapted to directly process received optical and radio signals.

Implementations of traffic preemption systems may utilize implementations of a first method of identifying a vehicle for a traffic preemption system. Implementations of the method may include transmitting an optical signal adapted to identify the existence of a vehicle to an intersection preemption unit using an optical transmitter included in a vehicle preemption unit mounted to the vehicle. The method may also include receiving the optical signal at an optical receiver supported by a traffic light support fixture where the optical receiver is included in the intersection preemption unit and the intersection preemption unit is adapted to distinguish between two or more vehicles each equipped with one of the vehicle preemption units. The method may include transmitting a radio signal from an intersection radio transceiver in response to receiving the optical signal where the radio signal includes information adapted to allow the vehicle preemption unit to uniquely identify the vehicle to the intersection preemption unit and where the intersection radio transceiver is included in the intersection preemption unit. The method may include receiving the radio signal using a vehicle radio transceiver included in the vehicle preemption unit and generating a vehicle identifying characteristic unique to the vehicle using a vehicle controller included in the vehicle preemption unit where the vehicle identifying characteristic is adapted to allow an intersection controller included in the intersection preemption unit to distinguish between the two or more vehicles. The method also may include sending the vehicle identifying characteristic to the intersection preemption unit from the vehicle preemption unit through an optical signal, a radio signal, or a combination of an optical signal and a radio signal and receiving the optical signal, the radio signal, or the combination of the optical signal and the radio signal at the intersection preemption unit. The method may include uniquely identifying the two or more vehicles using the vehicle identifying characteristic and the intersection controller.

Implementations of a first method of identifying a vehicle for a traffic preemption system may include one, all, or any of the following:

Receiving the optical signal at the optical receiver may further include indicating the existence of the optical signal to the intersection controller included in the intersection preemption unit.

Receiving the optical signal at the optical receiver may further include reporting one of frequency, pulse rate, and amplitude of the optical signal to the intersection controller included in the intersection preemption unit.

Generating a vehicle identifying characteristic unique to the vehicle using a vehicle controller and sending the vehicle identifying characteristic to the intersection preemption unit may further include adding a time delay unique to the vehicle to a time included in the radio signal using the vehicle controller and including the time delay in one or more optical signals sent from the optical transmitter of the vehicle preemption unit.

The method may further include avoiding signal collisions between two or more vehicles equipped with vehicle preemption units that are approaching the same intersection simultaneously through the time delay included in the one or more optical signals.

Generating a vehicle identifying characteristic unique to the vehicle using the vehicle controller and sending the vehicle identifying characteristic to the intersection preemption unit may further include adding a time delay unique to the vehicle to a time included in the radio signal with the vehicle controller and including the time delay in one or more radio signals sent from the vehicle radio transceiver of the vehicle preemption unit.

The method may further include avoiding signal collisions between two or more vehicles equipped with vehicle preemption units that are approaching the same intersection simultaneously through the time delay included in the one or more radio signals.

Generating the vehicle identifying characteristic unique to the vehicle using a vehicle controller may further include generating the vehicle identifying characteristic by adding a time stamp, number code, random number, unique pattern, cyclical redundancy, or code to a corresponding time stamp number code, random number, unique pattern, cyclical redundancy, or code included in the radio signal using the vehicle controller where the resulting time stamp, number code, random number, unique pattern, cyclical redundancy, or code is adapted to uniquely identify the vehicle on which the vehicle preemption unit is mounted. The method may further include including the time delay in one or more optical signals sent from the optical transmitter of the vehicle preemption unit or including the time delay in one or more radio signals sent from the radio transceiver of the vehicle preemption unit.

Sending the vehicle identifying characteristic to the intersection preemption unit may further include simultaneously sending a radio signal from the vehicle radio transceiver and sending an optical signal from the optical transmitter.

Simultaneously sending the radio signal from the vehicle radio transceiver and sending the optical signal from the optical transmitter may further include sending the radio signal and the optical signal at one of a derived, a random, a programmed, a varying, and a dithered time and wherein the vehicle identifying characteristic includes a time at which the intersection controller simultaneously receives the optical signal and the radio signal sent by the vehicle preemption unit mounted to the vehicle.

Transmitting the radio signal from the intersection radio transceiver in response to receiving the optical signal, receiving the radio signal using the vehicle radio transceiver, generating the vehicle identifying characteristic unique to the vehicle using the vehicle controller, and sending the vehicle identifying characteristic to the intersection preemption unit from the vehicle preemption unit may further include transmitting a radio signal using the intersection radio transceiver where the radio signal includes an absolute timing pulse adapted to establish an initial reference time for use by the vehicle controller; receiving the absolute timing pulse using the vehicle radio transceiver; generating the vehicle identifying characteristic by calculating a time delay adapted to uniquely identifying the vehicle using the vehicle controller, the absolute timing pulse, and a random number unique to the vehicle to which the vehicle preemption unit is mounted; and sending an optical signal to the intersection preemption unit using the optical transmitter of the vehicle preemption unit where the optical signal includes the time delay. The method may further include sending one or more radio timing pulses using the vehicle radio transceiver at a predetermined time relationship relative to a time of sending of the optical signal to the intersection preemption unit where the one or more radio timing pulses include encoded indentifying information including the vehicle identifying characteristic and where the identifying information is encoded by the vehicle controller through offsetting the one or more radio timing pulses using a single fixed offset, a set of offset values, and an initial reference pulse; receiving the one or more radio timing pulses and the optical signal using the intersection radio transceiver and the optical receiver, respectively; decoding the one or more radio timing pulses using the intersection controller to retrieve the identifying information including the vehicle identifying characteristic; and identifying the two or more vehicles by correlating the one or more optical signals received by the intersection preemption unit and the identifying information including the vehicle identifying characteristic using the intersection controller.

Transmitting the radio signal from the intersection radio transceiver in response to receiving the optical signal, receiving the radio signal using the vehicle radio transceiver, generating the vehicle identifying characteristic unique to the vehicle using the vehicle controller, and sending the vehicle identifying characteristic to the intersection preemption unit from the vehicle preemption unit may further include transmitting a radio signal using the intersection radio transceiver where the radio signal includes an absolute timing pulse adapted to establish an initial reference time for use by the vehicle controller; receiving the absolute timing pulse using the vehicle radio transceiver; generating a vehicle identifying characteristic by calculating a time delay adapted to uniquely identify the vehicle using the vehicle controller, the absolute timing pulse, and a random number unique to the vehicle to which the vehicle preemption unit is mounted; and sending a radio signal to the intersection preemption unit using the vehicle radio transceiver of the vehicle preemption unit where the radio signal includes the time delay. The method may also include sending one or more radio timing pulses using the vehicle radio transceiver where the one or more radio timing pulses include encoded identifying information including the vehicle identifying characteristic adapted to identify the vehicle to which the vehicle preemption unit is mounted where the identifying information is encoded by the vehicle controller through offsetting the one or more radio timing pulses using a single fixed offset, a set of offset values, or an initial reference pulse; receiving the one or more radio timing pulses using the intersection radio transceiver; decoding the one or more radio timing pulses using the intersection controller to decode the identifying information including the vehicle identifying characteristic; and identifying the one or more vehicles equipped with a vehicle preemption unit approaching the intersection with the intersection controller and the retrieved identifying information including the vehicle identifying characteristic.

Implementations of traffic preemption systems may utilize implementations of a second method of identifying a vehicle for a traffic preemption system. Implementations of the method may include transmitting an optical signal from an optical transmitter included in a vehicle preemption unit where the optical signal includes an optical communication pattern and where the optical signal is adapted to optically identify the existence of a vehicle to an intersection preemption unit. The method may also include receiving the optical signal at an optical receiver supported by a traffic light support fixture where the optical receiver is included in the intersection preemption unit which is adapted to distinguish between two or more vehicles each equipped with a vehicle preemption unit. The method may include transmitting a radio signal from a vehicle radio transceiver included in the vehicle preemption unit where the radio includes a corresponding optical communication pattern and a vehicle identifying characteristic adapted to allow an intersection controller included in the intersection preemption unit to distinguish between two or more vehicles each equipped with one of the vehicle preemption units and to receive vehicle status information adapted to communicate an operating condition or status of the vehicle. The method may also include receiving the radio signal at an intersection radio transceiver included in the intersection preemption unit and uniquely identifying the two or more vehicles using the vehicle identifying characteristic and the intersection controller.

Implementations of a second method of identifying a vehicle for a traffic preemption system may include one, all, or any of the following:

The optical communication pattern may be a defined strobe, a beacon pattern, or a frequency and the corresponding optical communication pattern may be the same defined strobe, the same beacon pattern, the same frequency, a code representation of the pattern, or a code representation of the frequency of the optical signal.

The method may further include varying the time of transmission of the optical signal and the radio signal from the vehicle preemption unit to avoid collision of an optical signal or a radio signal transmitted from one or more other vehicles each equipped with a vehicle preemption unit.

Implementations of traffic preemption systems may utilize implementations of a third method of identifying a vehicle for a traffic preemption system. Implementations of the method may include transmitting an optical signal from an optical transmitter included in a vehicle preemption unit where the optical signal includes an optical communication pattern and where the optical signal is adapted to optically identify the existence of a vehicle to an intersection preemption unit. The method also may include receiving the optical signal at an optical receiver supported by a traffic light support fixture where the optical receiver is included in the intersection preemption unit and is adapted to distinguish between two or more vehicles each equipped with one of the vehicle preemption units. The method may include transmitting a switching radio signal to the vehicle preemption unit using the intersection radio transceiver and receiving the switching radio signal at the vehicle radio transceiver. The method may include altering a characteristic of the optical signal in response to receiving the switching radio signal by processing the optical signal with a vehicle controller included in the vehicle preemption unit. The method may also include uniquely identifying the two or more vehicles using the altered characteristic of the optical signal and the intersection controller.

Implementations of a third method of identifying a vehicle for a traffic preemption system may include one, all, or any of the following:

The optical communication pattern may be a defined strobe, a beacon pattern, or a frequency.

The method may further include reverting the altered characteristic of the optical signal to an original characteristic after the vehicle has moved a predetermined distance toward or away from the intersection.

If the optical signal is received by a second intersection preemption unit after the characteristic of the optical signal has been altered in response to receiving a switching signal from a first intersection preemption unit at a first intersection, the method may include sending an engagement radio signal from the vehicle preemption unit to the second intersection preemption unit in response to receiving a switching signal from the second intersection preemption unit. The engagement radio signal may be adapted to inform the second intersection preemption unit that the vehicle is engaged with the first intersection preemption unit at the first intersection. The method may also include sending one or more radio signals to the second intersection preemption unit where the one or more radio signals include a vehicle identifying characteristic adapted to allow a second intersection controller included in the second intersection preemption unit to distinguish between two or more vehicles each equipped with one of the vehicle preemption units and to receive vehicle status information adapted to communicate an operating condition or status of the vehicle.

The method may further include transmitting a radio signal from a vehicle radio transceiver included in the vehicle preemption unit where the radio signal includes a corresponding optical communication pattern and where the radio signal is transmitted on a default operating frequency or channel. The method may also include receiving the radio signal on the default operating frequency or channel at an intersection radio transceiver included in the intersection preemption unit. Altering a characteristic of the optical signal may include altering a characteristic of the radio signal in response to receiving the switching radio signal by processing the radio signal with the vehicle controller included in the vehicle preemption unit. Uniquely identifying two or more vehicles using the altered characteristic of the optical signal may further include uniquely identifying the two or more vehicles using the altered characteristic of the radio signal with the intersection controller.

The corresponding optical communication pattern may be the same defined strobe, the same beacon pattern, the same frequency, a code representation of the pattern, or a code representation of the frequency of the optical signal.

The method may further include reverting the altered characteristic of the optical signal and reverting the changed characteristic of the radio signal to an original characteristic, respectively, after the vehicle has moved a predetermined distance toward or away from the intersection.

If the optical signal and the radio signal are received by a second intersection preemption unit after the characteristic of the optical signal and the characteristic of the radio signal have been altered in response to receiving a switching signal from a first intersection preemption unit at a first intersection, the method may further include sending an engagement radio signal from the vehicle preemption unit to the second intersection preemption unit in response to receiving a switching signal from the second intersection preemption unit where the engagement radio signal is adapted to inform the second intersection preemption unit that the vehicle is engaged with the first intersection preemption unit at the first intersection. The method may also include sending one or more radio signals to the second intersection preemption unit where the one or more radio signals include a vehicle identifying characteristic adapted to allow a second intersection controller included in the second intersection preemption unit to distinguish between two or more vehicles each equipped with one of the vehicle preemption units and to receive vehicle status information adapted to communicate an operating condition or status of the vehicle.

Implementations of traffic preemption systems may utilize implementations of a fourth method of identifying a vehicle for a traffic preemption system. Implementations of the method may include transmitting an optical signal from an optical transmitter included in a vehicle preemption unit where the optical signal includes an optical communication pattern and where the optical signal is adapted to optically identify the existence of a vehicle to an intersection preemption unit. The method also may include receiving the optical signal at an optical receiver supported by a traffic light support fixture where the optical receiver is included in the intersection preemption unit and is adapted to distinguish between two or more vehicles each equipped with one of the vehicle preemption units. The method may also include transmitting a radio signal from a vehicle radio transceiver including in the vehicle preemption unit where the radio signal includes a corresponding optical communication patter and where the radio signal is transmitted on a default operating frequency or channel. The method may include receiving the radio signal on the default operating frequency or channel at an intersection radio transceiver included in the intersection preemption unit, transmitting a switching radio signal to the vehicle preemption unit using the intersection radio transceiver, and receiving the switching radio signal at the vehicle radio transceiver. The method may include altering a characteristic of the radio signal in response to receiving the switching radio signal by processing the radio signal with a vehicle controller included in the vehicle preemption unit. The method may also include uniquely identifying the two or more vehicles using the altered characteristic of the radio signal and the intersection controller.

Implementations of a fourth method of identifying a vehicle for a traffic preemption system may include one, all, or any of the following:

The optical communication pattern may be a defined strobe, a beacon pattern, or a frequency and the corresponding optical communication pattern is the same defined strobe, the same beacon pattern, the same frequency, a code representation of the pattern, or a code representation of the frequency of the optical signal.

The method may further include reverting the altered characteristic of the radio signal to an original characteristic after the vehicle has moved a predetermined distance toward or away from the intersections.

If the radio signal is received by a second intersection preemption unit after the characteristic of the radio signal has been altered in response to receiving a switching signal from a first intersection preemption unit at a first intersection, the method may include sending an engagement radio signal from the vehicle preemption unit to the second intersection preemption unit in response to receiving a switching signal from the second intersection preemption unit where the engagement radio signal is adapted to inform the second intersection preemption unit that the vehicle is engaged with the first intersection preemption unit at the first intersection. The method may also include sending one or more radio signals to the second intersection preemption unit where the one or more radio signals include a vehicle identifying characteristic adapted to allow a second intersection controller included in the second intersection preemption unit to distinguish between two or more vehicles each equipped with one of the vehicle preemption units and to receive vehicle status information adapted to communicate an operating condition or status of the vehicle.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended traffic preemption system and/or assembly procedures for a traffic preemption system will become apparent for use with particular implementations from this disclosure. Accordingly, for example, although particular implementations are disclosed, such implementations and implementing components may comprise any shape, size, style, type, model, version, measurement, concentration, material, quantity, and/or the like as is known in the art for such traffic preemption systems and implementing components, consistent with the intended operation.

Figure 1:
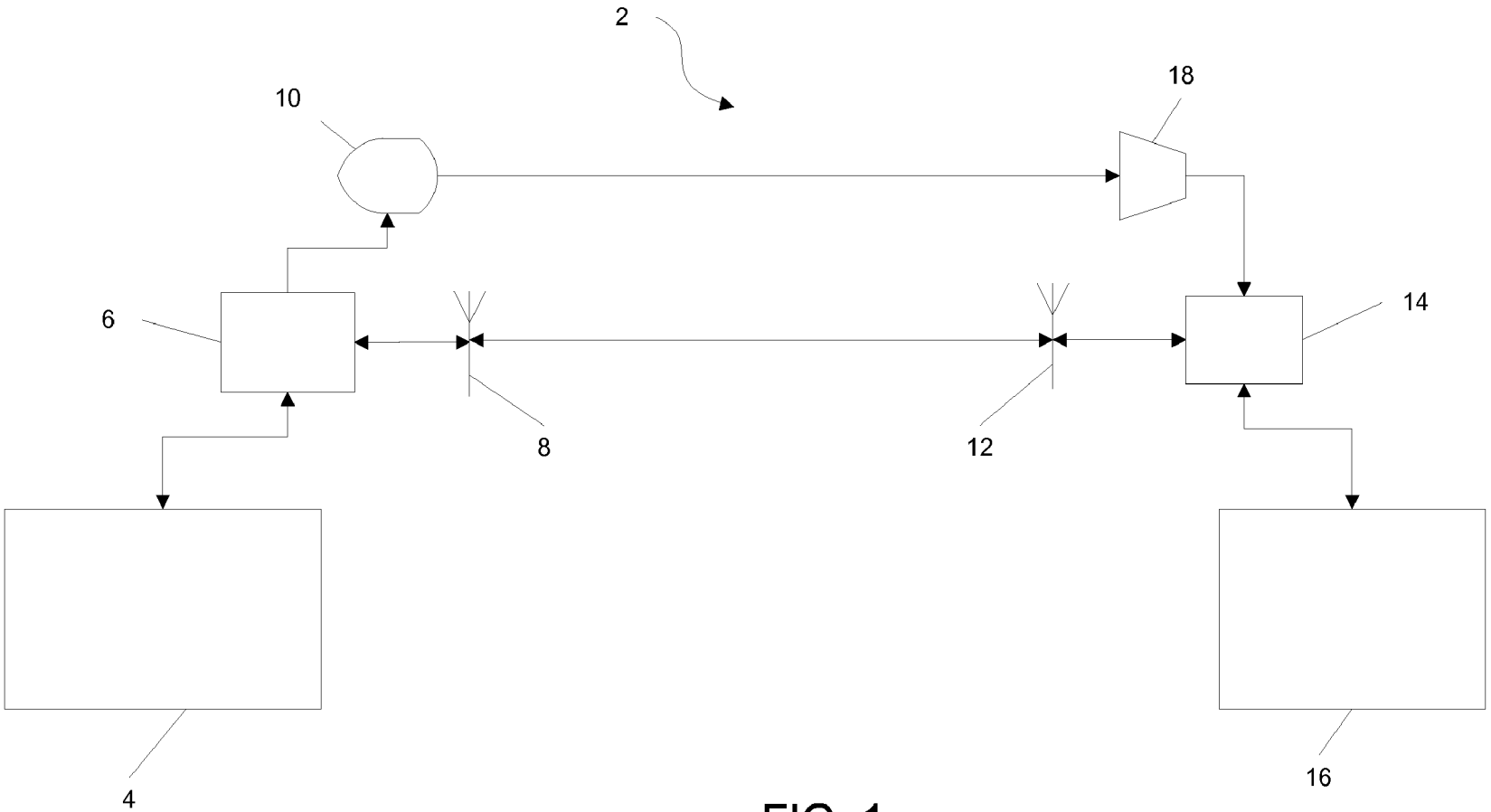
FIG. 1 is a block diagram of an implementation of a traffic preemption system.

Referring to FIG. 1, a block diagram of an implementation of a traffic preemption system 2 is illustrated. As illustrated, the system 2 includes a vehicle 4 to which is mounted a vehicle preemption unit 6. The vehicle 4 may be any land, air, or water vehicle, and in particular implementations may include, but is not limited to, an emergency vehicle, such as a police car, fire engine, or ambulance, or a high priority non-emergency vehicle, such as a city transit vehicle or a dignitary vehicle. The vehicle preemption unit 6 includes a vehicle radio transceiver coupled with an antenna 8 and an optical transmitter 10. The radio transceiver is adapted to communicate bidirectionally via radio signals sent using the antenna 8 with a corresponding antenna 12 of an intersection radio transceiver included in an intersection preemption unit 14 coupled with an intersection system controller 16. The intersection system controller 16 may be any of a wide variety of conventional traffic light controllers and may be located in any of a wide variety of locations at or near an intersection (such as on the ground adjacent to the sidewalk on one corner of the intersection).

The optical transmitter 10 is adapted to communicate unidirectionally with an optical receiver 18 included in the intersection preemption unit. The optical transmitter 10 and optical receiver 18 are adapted to send and receive any of a wide variety of optical signals using an optical communication pattern. Examples of optical communication patterns include by non-limiting example, strobed optical signals, optical signals with a defined pattern, optical signals with a particular radiation frequency or amplitude, or any other type of optical signal. Optical signals with a particular radiation frequency include optical signals that are transmitted using various frequencies of light, and, correspondingly, different light colors (visible, ultraviolet, infrared, etc.). In particular implementations, only optical signals may be used to transmit identifying information regarding the vehicle 4 to the intersection preemption unit 14; in others, only radio signals may be used, and in others, a combination of optical signals and radio signals may be employed.

Figure 2:
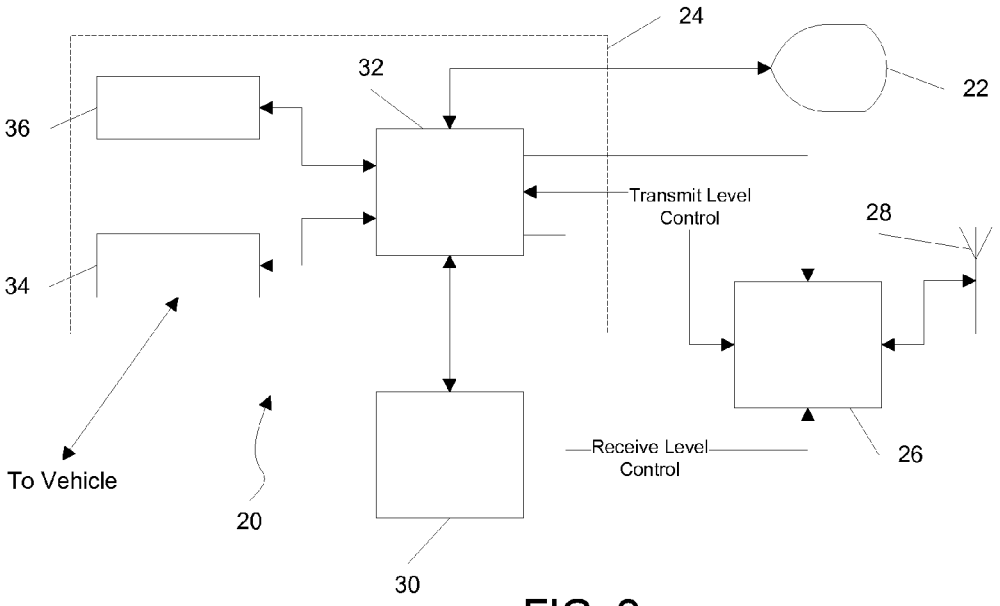
FIG. 2 is a block diagram of an implementation of a vehicle preemption unit.

Referring to FIG. 2, a block diagram of an implementation of a vehicle preemption unit 20 is illustrated. As illustrated, the vehicle preemption unit 20 includes an optical transmitter 22 coupled to a vehicle controller 24. A vehicle radio transceiver 26 is coupled to the vehicle controller 24 and includes an antenna 28. One or more power supplies 30 may be coupled with the vehicle controller 24 or may be coupled with any of the other components of the vehicle preemption unit 20 individually. As illustrated, the vehicle controller 24 may include a processor/memory module 32, a hardware interface 34, and an operator interface 36. The operator interface 36 may be adapted to permit a user of the vehicle preemption unit to turn on or off, activate, adjust operating parameters, or troubleshoot the unit, or perform other desired functions. The hardware interface 34 may be adapted to communicate directly with the vehicle to which the vehicle preemption unit 20 is mounted. The hardware interface 34 may be adapted to receive and transmit to the processor/memory module 32 any of a wide variety of signals from the vehicle relating to a status or condition of the vehicle, including, by non-limiting example, turn signal activation, vehicle speed, wheel rotation sensor information, vehicle light system status, electrical power levels, brake sensors, vehicle type information, or any other vehicle-related information. The vehicle controller 24 may also be adapted in particular implementations to perform any of a wide variety of operating functions, including, by non-limiting example, processing of optical signals for transmission, processing of received radio signals, processing of radio signals for transmission, calculation of time delays, encoding, decoding, or any other desired function.

Figure 3:
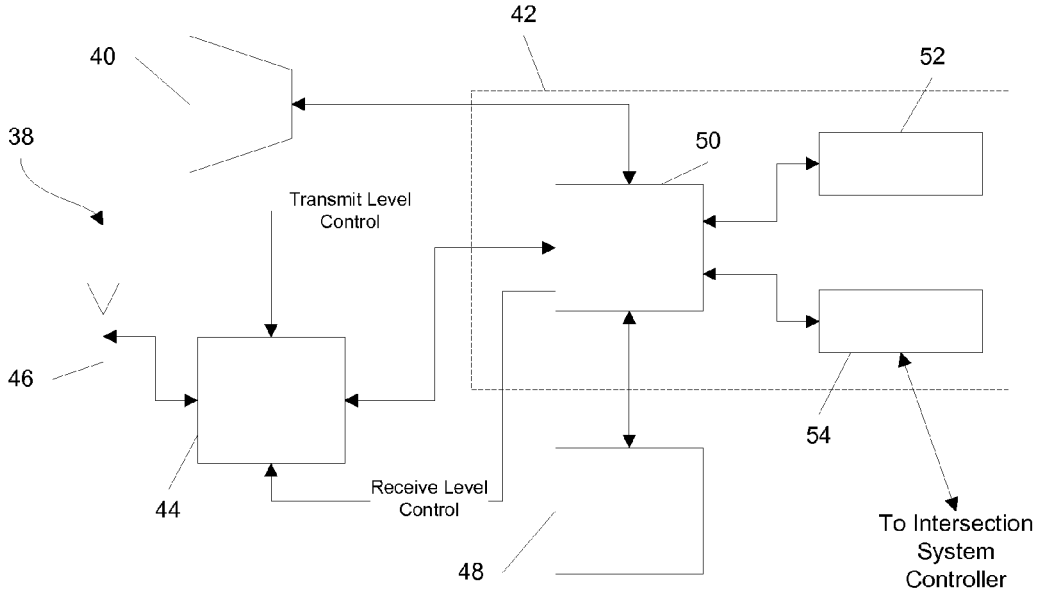
FIG. 3 is a block diagram of an implementation of an intersection preemption unit.

Referring to FIG. 3, a block diagram of an implementation of an intersection preemption unit 38 is illustrated. As illustrated, the intersection preemption unit may include an optical receiver 40 coupled with an intersection controller 42 and with an intersection radio transceiver 44. The intersection radio transceiver 44 receives and transmits radio signals through antenna 46. One or more power supplies 48 may be coupled with the intersection controller 42 or with any particular unit of the intersection preemption unit 38. As illustrated, the intersection controller 42 includes a processor/memory module 50, an operator interface 52, and a hardware interface 54. The operator interface 52 may be adapted to allow an operator to activate, deactivate, adjust parameters, troubleshoot, or otherwise interact with the intersection preemption unit 38. The hardware interface 54 may be adapted to communicate information with and receive information from the intersection system controller to which the intersection preemption unit 38 is coupled. In particular implementations, the hardware interface 54 may enable communication with other components of the intersection preemption unit 38 as well. Implementations of intersection controllers 42 may perform any of a wide variety of functions, including, by non-limiting example, processing of received optical signals, processing of received radio signals, processing of radio signals for transmission, calculation of time delays, calculation of time stamps, encoding, decoding, or any other desired function.

Figure 4:
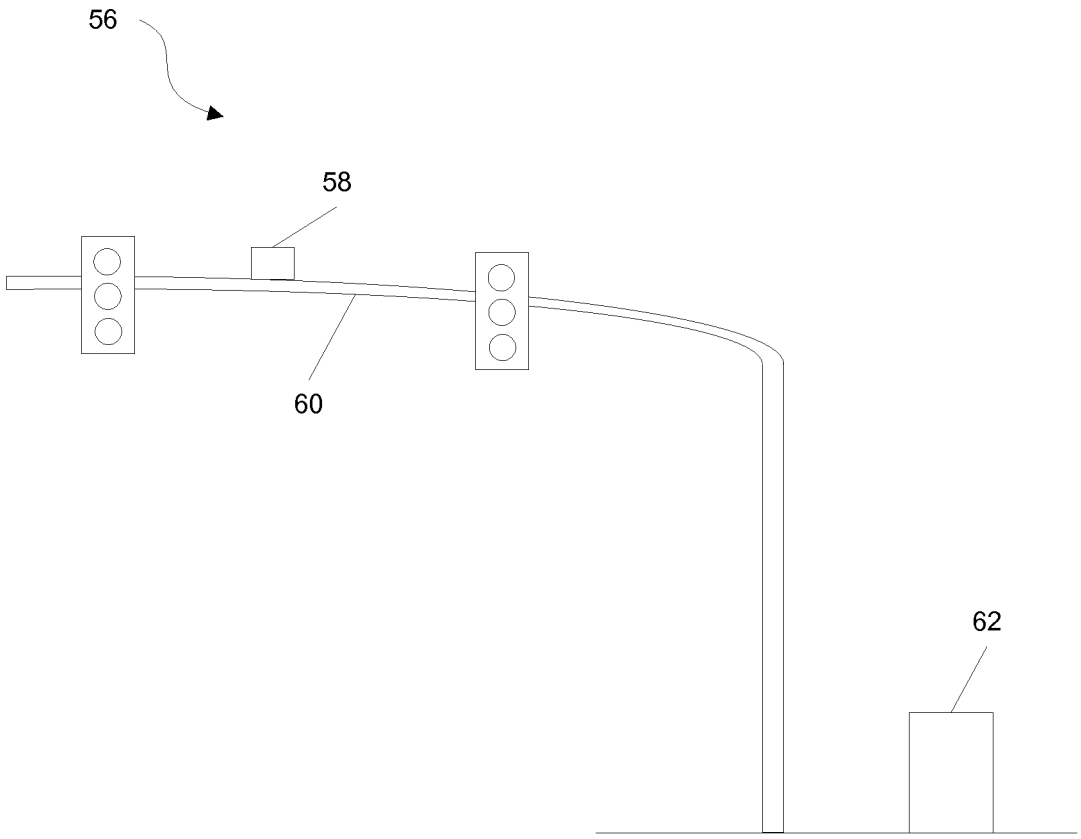
FIG. 4 is a front view of an implementation of a head mounted to an implementation of a traffic light support fixture.

Referring to FIG. 4, an implementation of an intersection preemption unit 56 is illustrated. As illustrated, the intersection preemption unit 56 may include a head 58 that is mounted to a traffic light support fixture 60. The head 58 may include several components of the intersection preemption unit 56 and perform one or more functions. For example, the head 58 may, in particular implementations, include an optical receiver and be connected via a wire with the rest of the intersection preemption unit 56 which may be included in the same housing as a intersection system controller 62. In other implementations, the head 58 may be connected to the rest of the intersection preemption unit 56 via a wireless connection. In some implementations, the head 58 may include the optical receiver and the antenna; in other implementations, the head 58 may include the optical receiver and the radio transceiver. In some implementations, the head 58 may include the entire intersection preemption unit 56 and communication with the intersection system controller 62 may take place via a wired or wireless connection. Any of a wide variety of implementations is possible and placement of the head 58 on any of a wide variety of conventional traffic light support fixture types is also contemplated.

Figure 5:
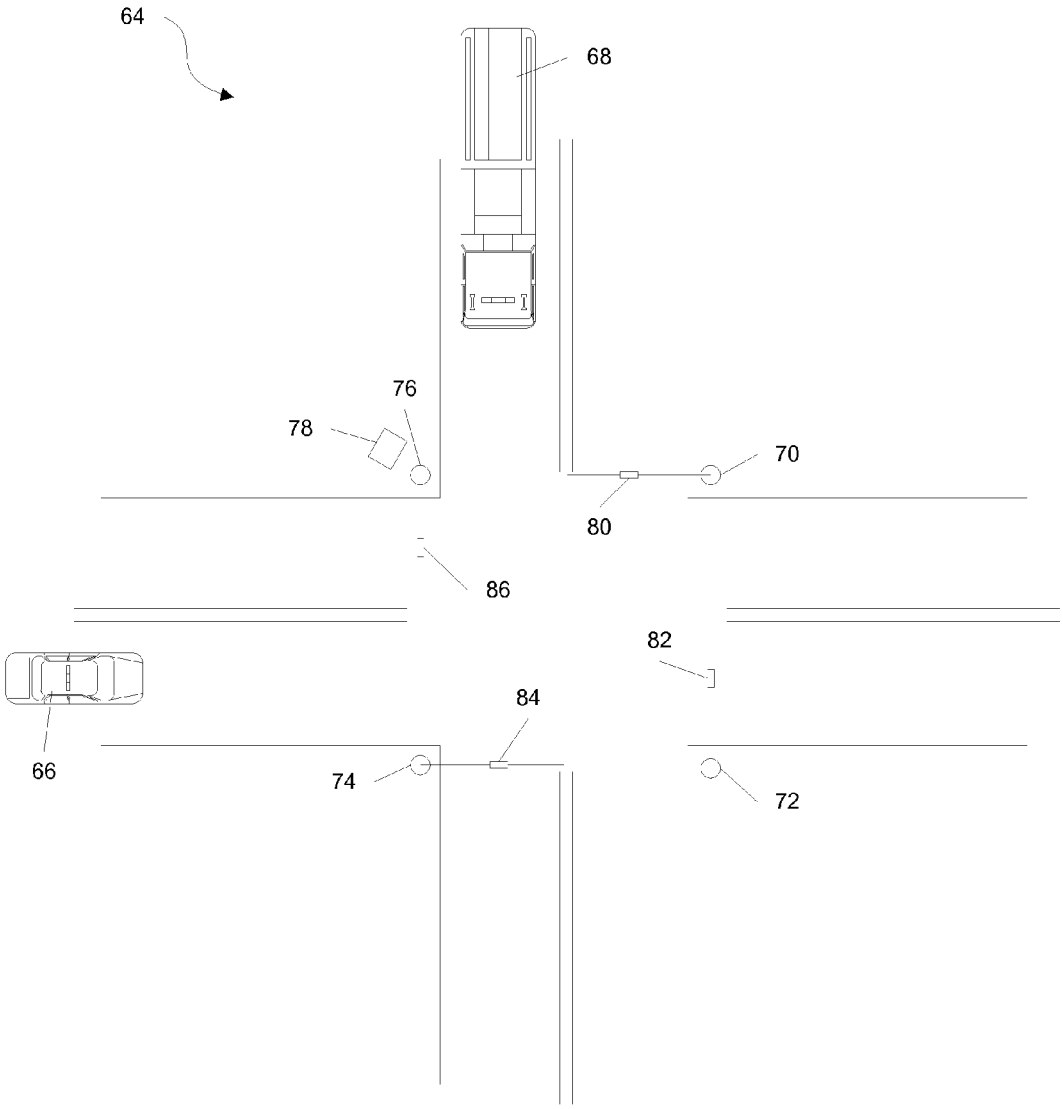
FIG. 5 is a diagram of an intersection with two vehicles approaching.

Referring to FIG. 5, a diagram of an intersection 64 with two vehicles approaching (a police car 66 and a fire engine 68) is illustrated. In the diagram illustrated, the vehicles are driving on the right side of the road; in parts of the world where vehicles drive on the left side of the road, the principles discussed are equally applicable, but the orientation and arrangement of the traffic light support fixtures will be different. As illustrated, four traffic light support fixtures 70, 72, 74, and 76 are located on a different corner of the intersection 64. An intersection system controller 78 that may include an intersection preemption unit is sited on one of the corners of the intersection 64 as well. As illustrated, heads 80, 82, 84, and 86 are mounted on traffic light support fixtures 70, 72, 74, and 76 and connected to the intersection preemption unit via wired or wireless connections. Each of the police car 66 and the fire engine 68 contains an implementation of a vehicle preemption unit. The driver of the police car 66 and fire engine 68 may activate the vehicle preemption unit in their vehicle in a wide variety of ways as they approach the intersection 66, including, by non-limiting example, a voice command, activating emergency light and sound systems, coming within a certain distance from the intersection, reaching or crossing a particular global positioning (GPS) coordinate or set of coordinates, or any other manual or automatic activation method.

Because the traffic preemption systems disclosed in this document are capable of employing optical, radio, or both optical and radio signals in order to identify the vehicles and to initiate preemptive changing of the traffic lights in favor of one of them, a wide variety of implementations of methods of identifying the vehicles and effecting preemption may be employed by the system. A number of methods of identifying a vehicle for a traffic preemption system are disclosed in this document that permit the intersection system controller to identify both the police car 66 and the fire engine 68 and preemptively change the traffic lights at the intersection 64 to allow one or both vehicles an optimum course through the intersection 64 depending upon its desired destination and/or priority. In addition, because both optical and radio signals can be employed, existing proprietary hardware (particularly optical signal based systems) may be utilized in implementations of traffic preemption systems disclosed in this document without requiring the removal, reinstallation, or reprogramming of the hardware.

Figure 6:
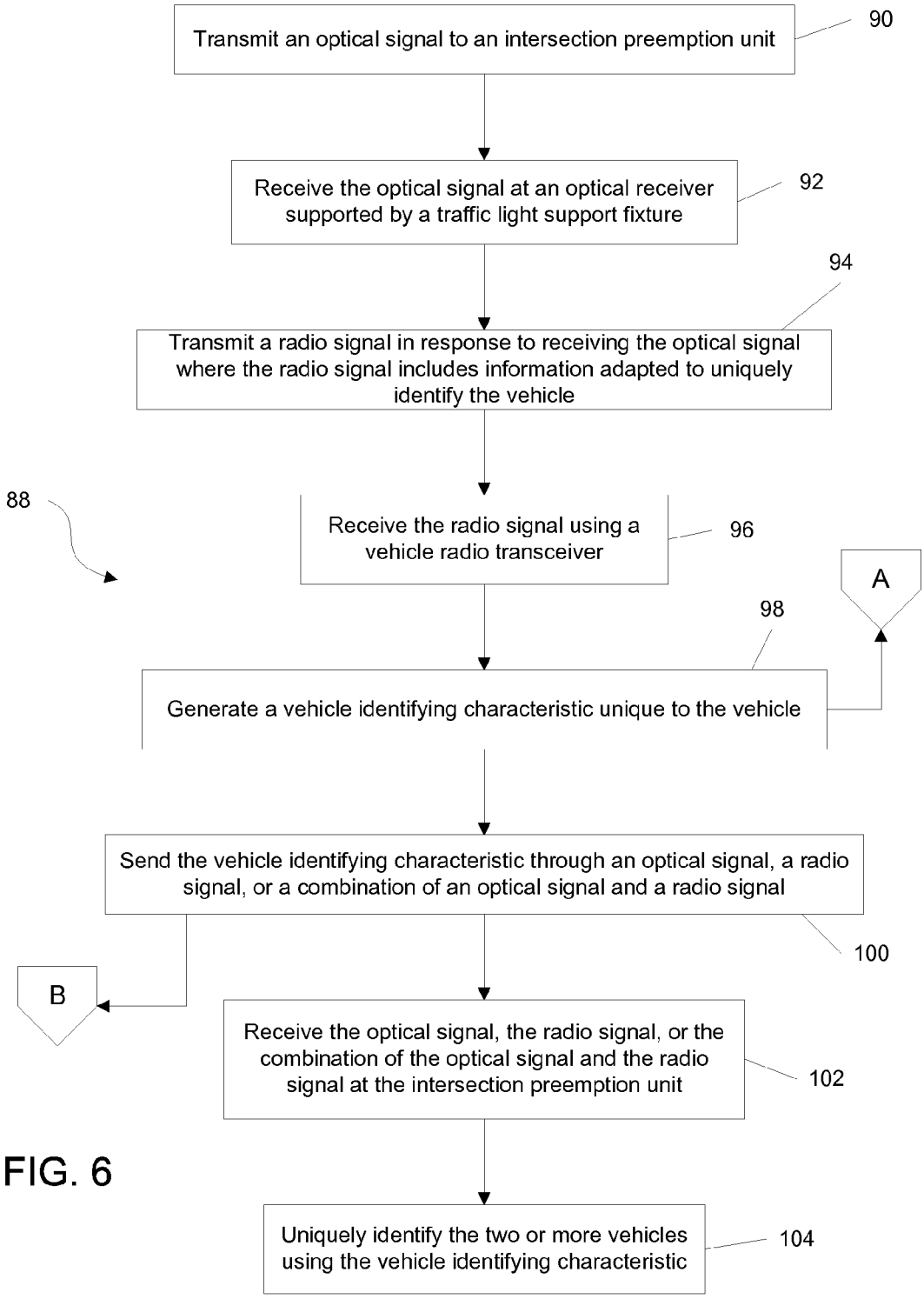
FIG. 6 is a flow chart of a first implementation of a method of identifying a vehicle for a traffic preemption system.

Referring to FIGS. 5 and 6, a first implementation of a method of identifying a vehicle for a traffic preemption system 88 is illustrated. At a high level and for the exemplary purposes of this disclosure, the method 88 may include the steps of transmitting a optical signal from the police car 66 to the optical receiver in the head 82, receiving the optical signal, and transmitting a radio signal from the intersection preemption unit to the police car 66 that includes information adapted to allow the vehicle preemption unit of the police car 66 to uniquely identify itself to the intersection preemption unit. Once the radio signal is received by the police car 66, the vehicle controller in the vehicle preemption unit mounted to the car 66 generates a vehicle identifying characteristic (which can be any information, signal, or signal characteristic adapted to uniquely identify the car 66) and sends it to the intersection preemption unit via an optical signal, radio signal, or a combination of an optical signal and radio signal. Once the intersection controller in the intersection preemption unit has obtained the vehicle identifying characteristic from the received signal(s), the intersection controller in the intersection preemption unit can then uniquely identify the police car 66 relative to the fire truck 68 or any other vehicle equipped with a vehicle preemption unit approaching the intersection 64.

Referring to FIG. 6, an implementation of the method 88 includes transmitting an optical signal adapted to identify the existence of a vehicle to an intersection preemption unit using an optical transmitter included in a vehicle preemption unit mounted to the vehicle (step 90) and receiving the optical signal at an optical receiver supported by a traffic light support fixture and included in intersection preemption unit (step 92). The method also includes transmitting a radio signal from a intersection radio transceiver included in the intersection preemption unit in response to receiving the optical signal where the radio signal includes information adapted to allow the vehicle preemption unit to uniquely identify the vehicle to the intersection preemption unit (step 94) and receiving the radio signal using a vehicle radio transceiver included in the vehicle preemption unit (step 96). The method includes generating a vehicle identifying characteristic unique to the vehicle using a vehicle controller included in the vehicle preemption unit where the vehicle indentifying characteristic is adapted to allow an intersection controller included in the intersection preemption unit to distinguish between two or more vehicles each equipped with one of the vehicle preemption units (step 98). The method also includes sending the vehicle identifying characteristic to the intersection preemption unit from the vehicle preemption unit through an optical signal, a radio signal, or a combination of an optical signal and a radio signal (step 100) and receiving the optical signal, the radio signal, or the combination of the optical signal and the radio signal at the intersection preemption unit (step 102). The method includes uniquely identifying the two or more vehicles using the vehicle identifying characteristic and the intersection controller (step 104). A wide variety of potential variations can be utilized in conjunction with implementations of the method 88 as will be discussed subsequently.

For example, receiving the optical signal at the optical receiver may include indicating the existence of the optical signal to the intersection controller. In implementations of the method 88 utilizing this variation, the characteristic of the optical signal that is used is simply its presence. If the signal is present, then the execution of implementations of the method 88 will proceed. Implementations of the method 88 utilizing this variation may be able to employ optical transmitters and optical receivers already present in vehicles that employ proprietary signaling techniques and/or encoding while not requiring that the intersection preemption unit understand or be able to decode the information in the transmitted signal; all that is required is to observe the presence of the signal.

In other related implementations, receiving the optical signal at the optical receiver may include determining and reporting the frequency, pulse rate, and/or amplitude of the optical signal to the intersection controller. In these implementations, more analysis of the signal is required than merely noting whether it is present, but the information needed to continue the method steps is relatively succinct—what the frequency, pulse rate, and/or amplitude of the optical signal being observed is. These implementations may provide an additional level of security as they require that more than the mere presence of an optical signal exist before the rest of the method 88 will be executed and signal preemption initiated.

Some variations may include where transmitting the radio signal from the intersection radio transceiver in response to receiving the optical signal further includes transmitting a radio signal having only one pulse. In these implementations, the radio signal back to the police car 66 will not be a continuous transmission; instead, a single radio signal pulse will be transmitted for reception and processing by the vehicle preemption unit in the car 66. Such implementations may improve various efficiencies of operation or may provide additional security by preventing individuals attempting to create an unauthorized vehicle preemption unit from being able to easily determine the frequency or characteristics of the transmitted radio signal coming from the intersection radio transceiver during operation.

Figure 7A:
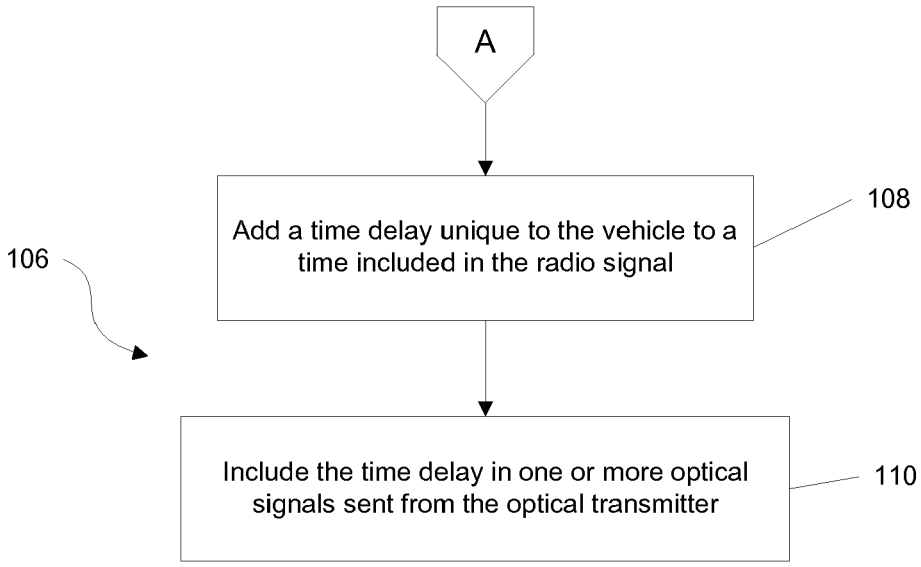
FIG. 7A is a flow chart of a first implementation of a method of identifying a vehicle for a traffic preemption system related to the implementation illustrated in FIG. 6.

Referring to FIGS. 5, 6, and 7A, a first particular implementation of a method of identifying a vehicle for a traffic preemption system 106 related to the method 88 illustrated in FIG. 6 is illustrated. As indicated at Indicator A on FIGS. 6 and 7A, generating the vehicle identifying characteristic using the vehicle controller may further include adding a time delay unique to the vehicle to a time included in the radio signal using the vehicle controller (step 108) and including the time delay in one or more optical signals sent from the optical transmitter of the vehicle preemption unit (step 110). In particular implementations, the method may include avoiding signal collisions between two or more vehicles equipped with vehicle preemption units that are approaching the same intersection simultaneously through the time delay. In the case illustrated in FIG. 5, a potential exists for the signals sent from the police car 66 to arrive at the head 82 and be transmitted to the intersection preemption unit at the same time signals sent from the fire engine 68 arrive at the head 84 and are transmitted. If the signals arrive simultaneously they may "collide," rendering the intersection preemption unit unable to properly process the signals. Because each vehicle initiating transmission of optical signals with the intersection preemption unit does so using a different time delay (and therefore, transmits at a different time relative to the other), the likelihood of signal collision may be substantially reduced.

In other particular implementations, a similar method to the one illustrated in FIG. 7A may be utilized, except that instead of the time delay being incorporated in the one or more optical signals sent from the optical transmitter, the time delay may be included in one or more radio signals sent from the vehicle radio transceiver of the vehicle preemption unit. In particular implementations, the time delay may be encoded or represented by a wide variety of radio signal features, including, by non-limiting example, a phase shift, a frequency offset, a modulation, one or more pulses, one or more missing pulses, a particular sequence of pulses, or any other desired signal feature. The time delay may also be used in these implementations to prevent signal collisions as described previously.

Figure 7B:
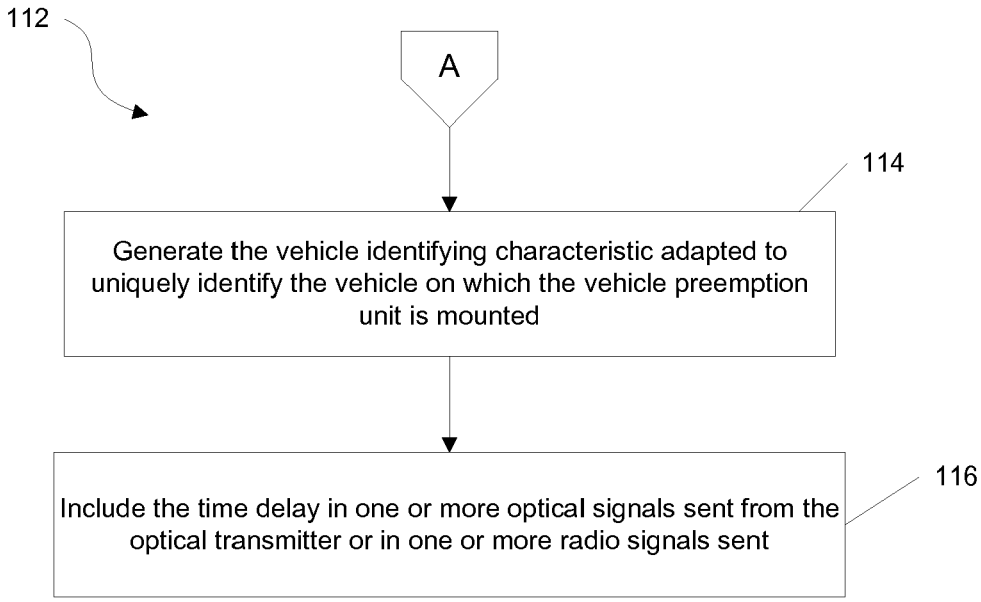
FIG. 7B is a flow chart of a second implementation of a method of identifying a vehicle for a traffic preemption system related to the implementation illustrated in FIG. 6.

Referring to FIGS. 6 and 7B, a second implementation of a method of identifying a vehicle for a traffic preemption system 112 related to the implementation of the method 88 illustrated in FIG. 6 is illustrated. As indicated at Indicator A on FIGS. 6 and 7B, generating the vehicle identifying characteristic using the vehicle controller may further include adding a time stamp, number code, random number, unique pattern, cyclical redundancy, or code to a corresponding time stamp, number code, random number, unique pattern, cyclical redundancy, or code included in the radio signal where the resulting time stamp, number code, random number, unique pattern, cyclical redundancy, or code is adapted to uniquely identify the vehicle on which the vehicle preemption unit is mounted (step 114). The method also includes including the time delay in one or more optical signals sent from the optical transmitter of the vehicle preemption unit or in one or more radio signals sent from the radio transceiver of the vehicle preemption unit (step 116).

In particular implementations of the method 112, sending the vehicle identifying characteristic to the intersection preemption unit may further include simultaneously sending a radio signal from the vehicle radio transceiver and sending an optical signal from the optical transmitter. Either or both of the signals may include the generated time delay in particular implementations. In some implementations, the radio signal and the optical signal may be sent simultaneously at a derived, a random, a programmed, a varying, or a dithered time. In these implementations, the vehicle identifying characteristic may also include the time at which the intersection controller simultaneously receives the optical signal and the radio signal sent by the vehicle preemption unit mounted to the vehicle. In all of the above described implementations, the varying of the time of sending of the signals and identifying a vehicle using the time of receipt of the signals may permit better identification of the vehicles and/or prevention of signal collisions.

Figure 8:
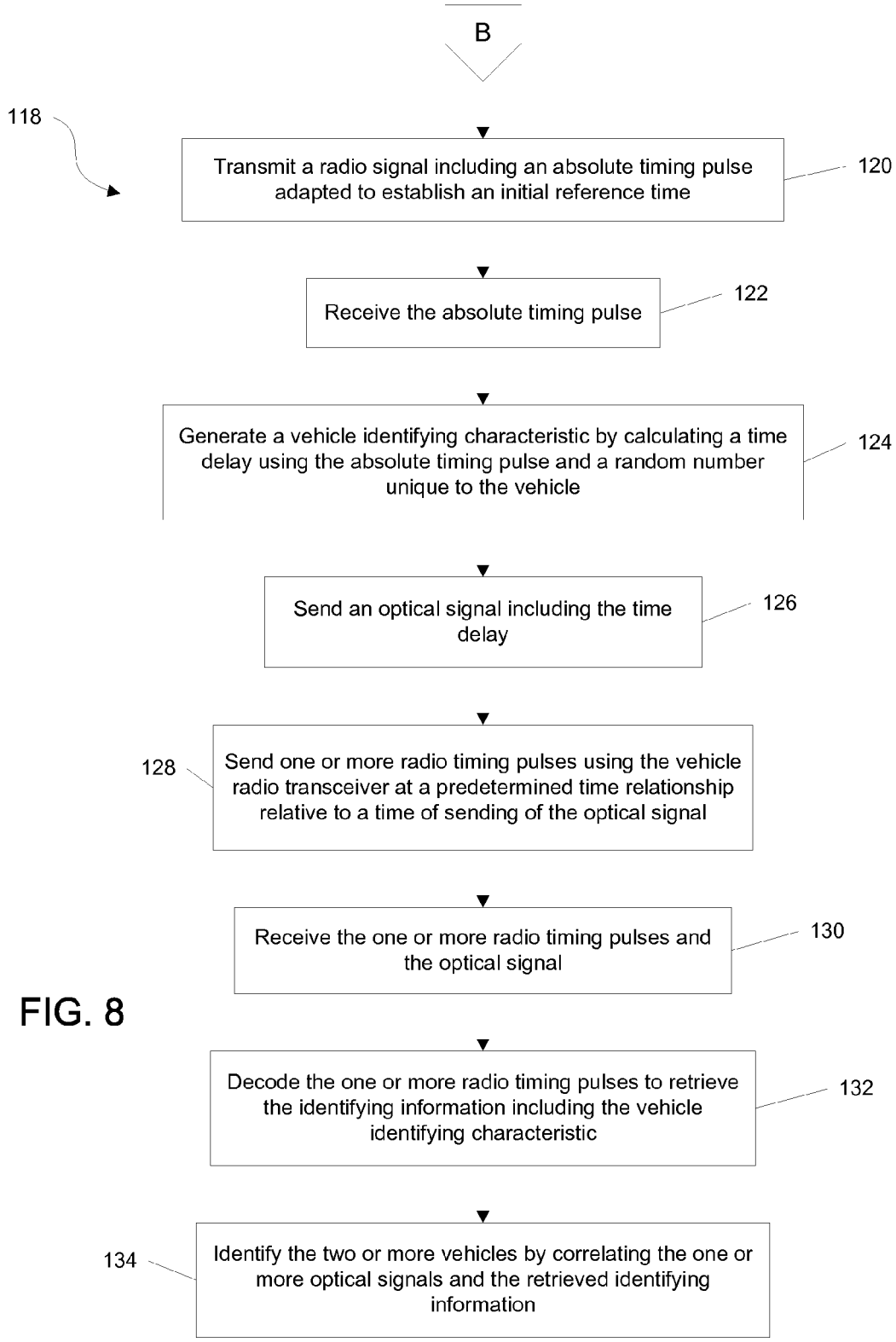
FIG. 8 is a flow chart of a third implementation of a method of identifying a vehicle for a traffic preemption system related to the implementation illustrated in FIG. 6.

Referring to FIGS. 6 and 8, a third implementation of a method of identifying a vehicle for a traffic preemption system 118 related to the method 88 illustrated in FIG. 6 is illustrated. As indicated by Indicator B, transmitting the radio signal from the intersection radio transceiver in response to receiving the optical signal (step 94), receiving the radio signal using the vehicle radio transceiver (step 96), generating the vehicle identifying characteristic unique to the vehicle using the vehicle controller (step 98), and sending the vehicle identifying characteristic to the intersection preemption unit from the vehicle preemption unit (step 100) may further include transmitting a radio signal using the intersection radio transceiver where the radio signal includes an absolute timing pulse adapted to establish an initial reference time for use by the vehicle controller (step 120). In particular implementations, the absolute timing pulse may contain a reference time for use by vehicles approaching the intersection. In other implementations, the absolute timing pulse may be a radio signal sent to all vehicles approaching the intersection that is sent and received by the vehicles at substantially the same time. In these implementations, the radio signal may include a request that the vehicles transmit identifying information (a vehicle identification number, a code, a random number, or any other uniquely identifying characteristic) to the intersection preemption unit. The method 118 may further include receiving the absolute timing pulse using the vehicle radio transceiver (step 122) and generating a vehicle identifying characteristic by calculating a time delay adapted to uniquely identify the vehicle using the vehicle controller, the absolute timing pulse, and a random number unique to the vehicle to which the vehicle preemption unit is mounted (step 124). The method 118 may also include sending an optical signal to the intersection preemption unit using the optical transmitter of the vehicle preemption unit where the optical signal includes the time delay (step 126).

Implementations of the method 118 may also include sending one or more radio timing pulses using the vehicle radio transceiver at a predetermined time relationship relative to a time of sending of the optical signal to the intersection preemption unit where the one or more radio timing pulses includes encoded identifying information including the vehicle identifying characteristic and where the identifying information is encoded through offsetting the one or more radio timing pulses using one of a single fixed offset, a set of offset values, or an initial reference pulse (step 128). The method 118 may further include receiving the one or more radio timing pulses and the optical signal using the intersection radio transceiver and the optical receiver, respectively (step 130) and decoding the one or more radio timing pulses using the intersection controller to retrieve the identifying information including the vehicle identifying characteristic (step 132). The method 118 may also include identifying the two or more vehicles by correlating the one or more optical signals received by the intersection preemption unit and the retrieved identifying information including the vehicle identifying characteristic using the intersection controller (step 134).

In particular implementations, instead of sending an optical signal to the intersection preemption unit using the optical transmitter of the vehicle preemption unit where the optical signal includes the time delay (step 126), the method may include sending a radio signal to the intersection preemption unit using the radio transceiver of the vehicle preemption unit where the radio signal includes the time delay. In all of the above described variations of the method 118, the additional encoding and sending of timing pulses may permit more accurate tracking of the speed of the vehicle, provide greater security, reduce the likelihood of compromising the system, or not require the use of proprietary encoding processes to send or retrieve information from the optical or radio signals.

Figure 9:
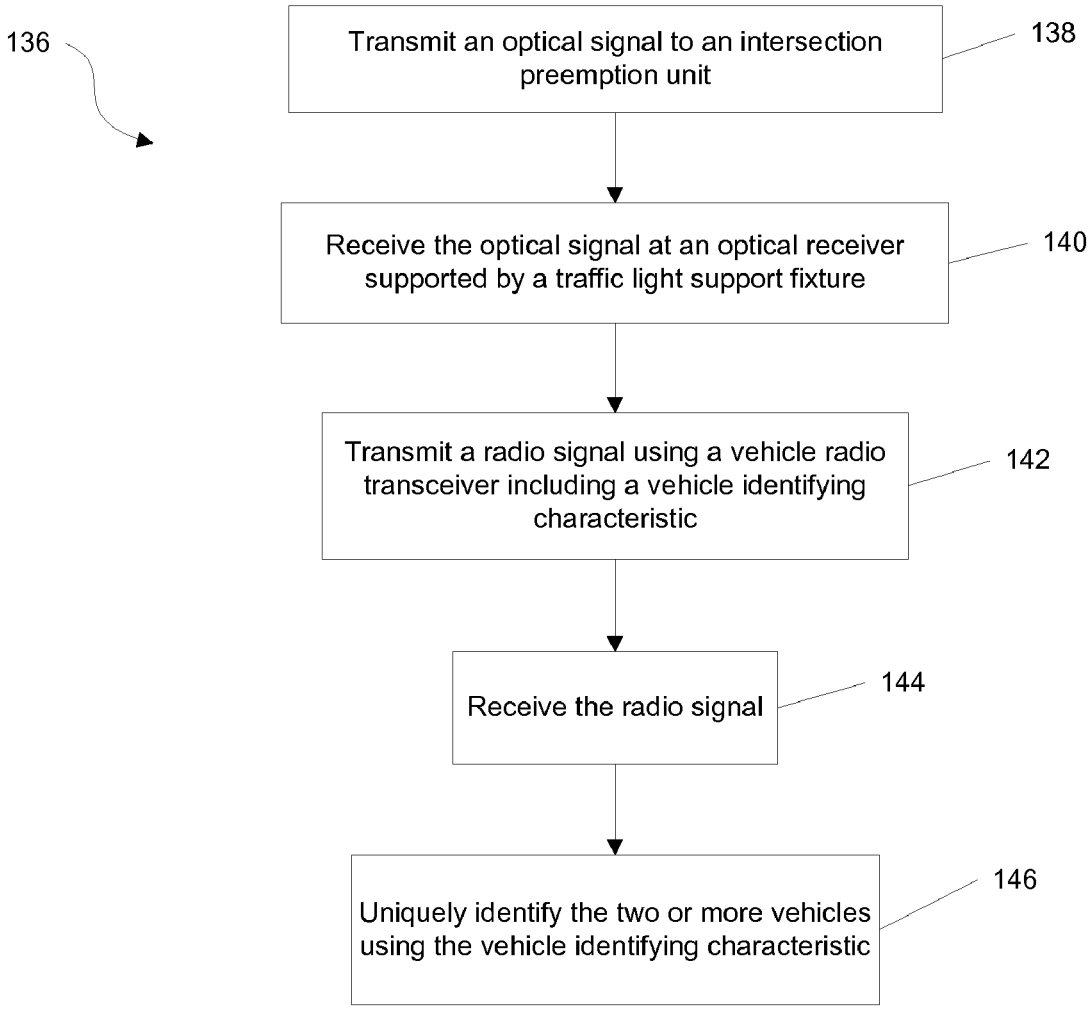
FIG. 9 is a flow chart of a second implementation of a method of identifying a vehicle for a traffic preemption system.

Referring to FIGS. 5 and 9, a second implementation of a method of identifying a vehicle for a traffic preemption system 136 is illustrated. At a high level, the method 136 includes transmitting an optical signal with a defined optical pattern from the police car 66 and receiving the optical signal at the head 82. The police car 66 then transmits a radio signal to the intersection preemption unit that contains the same pattern as the defined optical pattern or an encoded form of the pattern. The radio signal may also include a vehicle identifying characteristic and various vehicle status information about the operating condition or status of the vehicle (i.e., is the right turn signal on, etc.) Once the intersection preemption unit receives the radio signal, the intersection controller can use the vehicle identifying characteristic and/or the vehicle status information to uniquely identify the police car 66 relative to the fire engine 68. Depending upon the implementation, the vehicle identifying characteristic may be the particular defined optical pattern in the radio signal or may be any one of the other vehicle identifying characteristics disclosed in this document.

Referring to FIG. 9, particular implementations of the method 136 may include transmitting an optical signal using an optical transmitter included in a vehicle preemption unit where the optical signal includes an optical communication pattern. The optical communication pattern may be, by non-limiting example, a defined strobe, a beacon pattern, or a frequency where the optical signal is adapted to identify the existence of a vehicle to an intersection preemption unit (step 138). The method 136 also includes receiving the optical signal at an optical receiver supported by a traffic light support fixture where the optical receiver is included in the intersection preemption unit (step 140). The method 136 further includes transmitting a radio signal using a vehicle radio transceiver included in the vehicle preemption unit where the radio signal includes a corresponding optical communication pattern, which may be, by non-limiting example, the same defined strobe, same beacon pattern, same frequency, a code representation of the pattern, or a code representation of the frequency of the optical signal and where the radio signal also includes a vehicle identifying characteristic adapted to allow an intersection controller included in the preemption unit to distinguish between two or more vehicles each equipped with one of the vehicle preemption units and to receive vehicle status information adapted to communicate an operating condition or status of the vehicle (step 142). The code representation may include, in particular implementations, an index value to a table of defined frequency or signal pattern definitions (i.e., an index value of 0 would correspond with frequency 0 or pattern 0). In other implementations, the code representation may be created by mapping the frequency or pattern of the optical signal to a code using any of a wide variety of inverse mapping or post-processing systems and methods associated with the intersection preemption unit and using the received optical signal. In particular implementations, error correction parity bits could be generated using the received optical signal pattern and the error correction parity bits (or a code corresponding with the bits) could be sent as the code representation via the radio signal to the intersection controller, which then correlates the received error correction parity bits (or code) with the pattern of the received optical signal.

The method 136 may also include receiving the radio signal at an intersection radio transceiver included in the intersection preemption unit (step 144) and uniquely identifying the two or more vehicles using the vehicle identifying characteristic and the intersection controller (step 146). In particular implementations, because the optical signal and the radio signal contain the same optical communication pattern, the intersection preemption unit can be assured that the information in either the optical signal or the radio signal is from the same source and that either could be utilized to retrieve the vehicle identifying characteristic.

In particular implementations of the method 136, the method may further include varying the time of transmission of the optical signal and the radio signal from the vehicle preemption unit to avoid collision of an optical signal or a radio signal transmitted from one or more vehicles equipped with a vehicle preemption unit. Varying the time of transmission may be accomplished by any of a wide variety of methods, including those discussed in this document.

Figure 10:
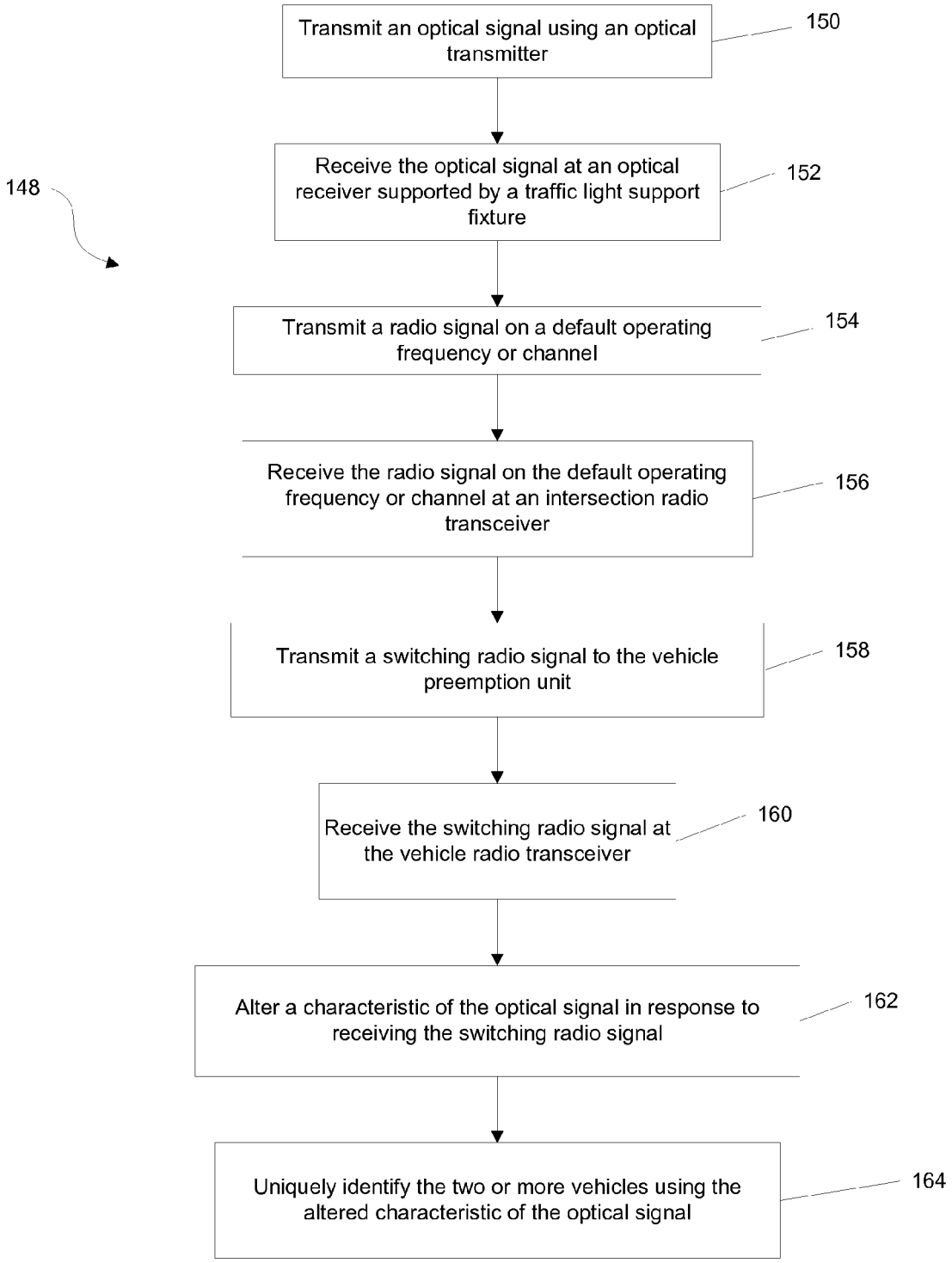
FIG. 10 is a flow chart of a third implementation of a method of identifying a vehicle for a traffic preemption system.

Referring to FIGS. 5 and 10, a third implementation of a method of identifying a vehicle for a traffic preemption system 148 is illustrated. At a high level, the method 148 includes transmitting an optical signal having a defined optical pattern from the police car 66. The police car 66 may also transmit a radio signal on a default operating frequency or channel to the intersection preemption unit that contains the same pattern as the defined optical pattern or an encoded form of the pattern. The intersection preemption unit then transmits a switching radio signal back to the vehicle preemption unit after receiving the two signals, which, when received, causes the police car 66 to change a characteristic of the optical signal, the radio signal, or both the optical signal and the radio signal being used for transmission. For example, the police car 66 could change the operating channel of its radio signals in response to receiving the switching radio signal. Because the radio signal is now transmitted on a different channel that the default channel, the intersection preemption unit can use the difference in channels to distinguish between radio signals coming from the police car 66 and from the fire engine 68 (with a mechanism in place to ensure that the two vehicles select a different channel in response to the switching radio signal). In various implementations, the optical signal only or both the optical signal and the radio signal may have their respective characteristics altered to enable the system to uniquely identify the vehicles because of the differences in the multiple signals being received.

Referring to FIG. 10, a particular implementation of the method 148 is illustrated. As illustrated, the method 148 may include transmitting an optical signal using an optical transmitter included in a vehicle preemption unit where the optical signal includes an optical communication pattern, which may be, in particular implementations, a defined strobe, a beacon pattern, or a frequency and where the optical signal is adapted to identify the existence of a vehicle to an intersection preemption unit (step 150). The method 148 may also include receiving the optical signal at an optical receiver supported by a traffic light support fixture where the optical receiver is included in the intersection preemption unit (step 152). The method also includes transmitting a switching radio signal to the vehicle preemption unit using the intersection radio transceiver where the switching radio signal is adapted to permit the intersection preemption unit to distinguish between two or more vehicles each equipped with one of the vehicle preemption units (step 158). The method 148 may also include receiving the switching radio signal at the vehicle radio transceiver (step 160) and altering a characteristic of the optical signal in response to receiving the switching radio signal using a vehicle controller included in the vehicle preemption unit (step 162). The method 148 also includes uniquely identifying the two or more vehicles using the altered characteristic of the optical signal and the intersection controller (step 164).

Particular implementations of the method 148 may also include transmitting a radio signal using the vehicle radio transceiver included in the vehicle preemption unit where the radio signal includes a corresponding optical pattern, which may be, by non-limiting example, the same defined strobe, same beacon pattern, same frequency, a code representation of the pattern, or a code representation of the frequency of the optical signal and where the radio signal is transmitted on a default operating frequency or channel (step 154). The method 148 may also includes receiving the radio signal on the default operating frequency or channel at an intersection radio transceiver included in the intersection preemption unit (step 156). In these implementations, the radio signal and the optical signal may both have their respective characteristics altered in response to receiving the switching signal and the altered characteristics of the radio signal and optical signal may be used to uniquely identify vehicles approaching the intersection.

In particular implementations of the method, the switching signal may contain, by non-limiting example, an intersection specific code, one or more radio pulses, a particular frequency, or any other radio signal characteristic. Because the radio signal and/or the optical signal may be altered from its original or default characteristic, in particular implementations, it may be desirable that the signal(s) be changed back to their original characteristics before the vehicle approaches another intersection. Accordingly, implementations of the method may include reverting the changed characteristic of the optical signal and/or the radio signal to an original characteristic after the vehicle has moved a predetermined distance toward or away from the intersection. In some implementations, the reversion of the signal(s) may take place once the traffic preemption process has been completed in favor of a particular vehicle; in others, when the vehicle has reached a certain distance away from the intersection; in some, when the vehicle is passing through the intersection; and in other implementations when the vehicle has passed through the intersection and is a certain distance away from the intersection.

In some situations, such as when two intersections are within a particular distance of each other, it may be possible for the optical receiver and/or intersection radio transceiver of a first intersection preemption unit and a second intersection preemption unit to acquire the optical signal and/or radio signal being transmitted by the vehicle preemption unit. If the second intersection preemption unit acquires the optical signal and/or radio signal after a switching signal has been sent by the first intersection preemption unit, then a process may be necessary to inform the second intersection preemption unit that the optical signal and/or radio signal it has received is altered and that the second intersection preemption unit needs to wait to begin interacting with the vehicle preemption unit until the optical signal and/or radio signal has returned to an original characteristic. This may be desirable to prevent a break in communication with the second intersection when the optical signal and/or radio signal revert back to their original values after passing through the first intersection.

Accordingly, implementations of the method 148 may include sending an engagement radio signal from the vehicle preemption unit to the second intersection preemption unit in response to receiving a switching signal from the second intersection preemption unit. The engagement radio signal may be adapted to inform the second intersection preemption unit that the vehicle is engaged with the first intersection preemption unit at a first intersection. In particular implementations, the engagement radio signal could include information that communicates to the second intersection preemption unit the likelihood that the vehicle will travel to the second intersection (instead of turning prior to the second intersection). The method may also include sending one or more radio signals to the second intersection preemption unit that includes a vehicle identifying characteristic adapted to allow a second intersection controller included in the second intersection preemption unit to distinguish between two or more vehicles each equipped with one of the vehicle preemption units and to receive vehicle status information adapted to communicate the operating condition or status of the vehicle. In particular implementations, no vehicle identifying characteristic or status information may be sent, but the signal may communicate a time at which the second intersection preemption unit should attempt to resend a switching signal and establish communication with the vehicle. Any of the other vehicle identifying characteristics and/or methods disclosed in this document could also be employed.

In particular implementations, the second intersection preemption unit may send one or more radio signals including status information and/or requests for the vehicle to revert back to the original signal characteristic or another specified signal characteristic when the vehicle is no longer engaged with the first intersection preemption unit. In some implementations, similar information (status and/or signal characteristics) may be directly transmitted from the first intersection preemption unit to the second intersection preemption unit. In such implementations, radio signals may also be used to allow the first intersection preemption unit to notify a second intersection preemption unit around a corner (and out of optical signal visibility) that the vehicle is coming and permit it to initiate the preemption process.

Figure 11:
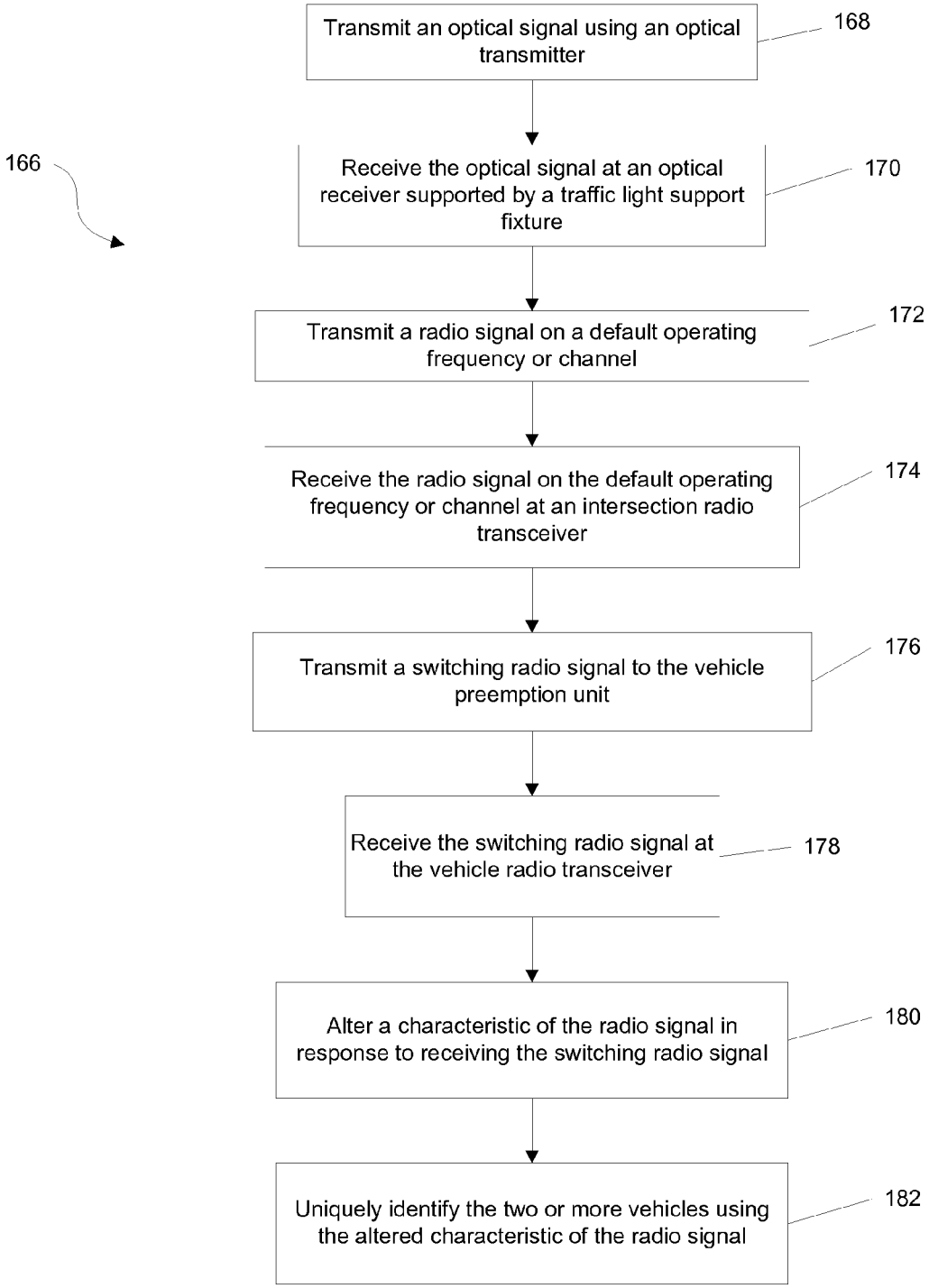
FIG. 11 is a flow chart of a fourth implementation of a method of identifying a vehicle for a traffic preemption system.

In various implementations of the method 148 just disclosed, the methods may be carried out with optical signals alone or with both optical signals and with radio signals. Referring to FIG. 11, an implementation of a fourth method of identifying a vehicle for a traffic preemption system 166 is illustrated. As illustrated, the method 166 includes transmitting an optical signal using an optical transmitter (step 168), receiving the optical signal at an optical receiver supported by a traffic light support fixture (step 170), and transmitting a radio signal on a default operating frequency or channel (step 172). The method may also include receiving the radio signal on the default operating frequency or channel at an intersection radio transceiver (step 174), and transmitting a switching radio signal to the vehicle preemption unit (step 176). The method also includes receiving the switching radio signal at the vehicle radio transceiver (step 178), altering a characteristic of the radio signal in response to receiving the switching radio signal (step 180), and uniquely identifying the two or more vehicles using the altered characteristic of the radio signal (step 182). Implementations of the method 166 may utilize a radio signal including a corresponding optical pattern, which may be, by non-limiting example, the same defined strobe, same beacon pattern, same frequency, a code representation of the pattern, or a code representation of the frequency of the optical signal. In addition, implementations of the method 166 may utilize any of the methods previously described for the method 148, including reverting the radio signal back to its original characteristic as well as utilizing engagement radio signals to communicate to a second intersection that the vehicle preemption unit is engaged with a first intersection. This is because implementations of the method 166 rely on altering the characteristic of the radio signal rather than altering the optical signal or both the optical signal and the radio signal. Any of a wide variety of potential combinations is possible.

In other particular implementations of the methods 148 and 166, no radio signals may be sent to the second intersection preemption unit; instead, after the vehicle has moved a predetermined distance toward or away from the intersection and after the changed characteristic(s) of the optical signal, the radio signal, or both the optical signal and the radio signal have reverted back to initial or original characteristic(s), the second intersection preemption unit may resend the second switching signal to the vehicle preemption unit in response to receiving the optical signal, radio signal, or both the optical signal and the radio signal, with their initial or original characteristic(s). In these implementations, the vehicle preemption unit may once again alter the characteristic of the optical signal, the radio signal, or both the optical signal and the radio signal in response to receiving the second switching signal by processing the optical signal, the radio signal, or both the optical signal and the radio signal with the vehicle controller and also uniquely identify the two or more vehicles using the altered characteristic of the optical signal, the radio signal, or both the optical signal and the radio signal. Any of a wide variety of other possibilities and combinations of optical signals, radio signals, or both optical signals and radio signals are possible.

The following three examples of the operation of three implementations of traffic preemption systems are for the exemplary purposes of this disclosure and illustrate various ways in which the principles disclosed may be implemented. In a first example, a vehicle approaches an intersection with the optical transmitter of its vehicle preemption unit sending an optical signal toward the intersection. A head receives the optical signal and, once the optical signal has risen above a certain preset level, the head transmits a head identifier (i.e., the number of the head) and a notification that a vehicle is approaching the intersection to the intersection preemption unit. In response to receiving the notification, the intersection preemption unit transmits a radio signal that can be received by all vehicles in the area of the intersection. The radio signal includes a request that any vehicles with their vehicle preemption units activated transmit their identifier, a vehicle identification number, via a radio signal using the vehicle radio transceivers of their respective vehicle preemption units. Those vehicles transmitting optical signals to the intersection respond to the request by transmitting a radio signal containing a unique vehicle identification number. Once the intersection preemption unit has received the radio signals, it determines how many vehicles are approaching the intersection. The intersection preemption unit then transmits a radio signal directed to each incoming vehicle using each vehicle's identification number that contains a request that the vehicle preemption unit change the pattern or frequency of the optical signal it is transmitting to a requested pattern or frequency. The intersection preemption unit then notes which of the heads detects the requested pattern or frequency in response to the transmitted radio signals and uses this information to determine from which directions the vehicles are approaching. Once optical signals have not been received after a predetermined period of time, the head(s) will transmit a signal to the intersection preemption unit that the vehicle(s) are no longer in optical signal view and the intersection preemption unit will cancel preemption. In particular implementations, the head may transmit the notification three times to the intersection preemption unit for each vehicle it detects.

In a second example, when a vehicle approaching the intersection activates its vehicle preemption unit, the vehicle controller selects a random pattern or frequency for the optical signal being transmitted using the optical transmitter. A head at an intersection receives the optical signal and transmits to the intersection preemption unit its head identifier and the pattern or frequency of the optical signal it is receiving. The intersection preemption unit then transmits a radio signal that can be received by all vehicles in the area of the intersection. The radio signal includes a request that the vehicles transmit their identifier, a vehicle identification number, via a radio signal using the vehicle radio transceivers of their vehicle preemption units. Those vehicles transmitting optical signals to the intersection respond to the request by transmitting a radio signal containing their respective vehicle identification number to the intersection preemption unit. With the received vehicle identification numbers, the intersection preemption unit can associate the different pattern or frequency of the optical signal being sent by each vehicle with each vehicle's vehicle identification number and the direction the particular vehicle is coming from (by knowing which head is receiving the particular pattern or frequency). Once the head(s) stop receiving optical signals for a predetermined period of time, the head(s) will transmit a signal to the intersection preemption unit that the vehicle(s) are no longer visible via optical signals and the intersection preemption unit will cancel preemption. In this example, the heads transmit the received pattern or frequency of the optical signal two times for each vehicle that is detected.

In a third example, a vehicle approaches an intersection with the optical transmitter of its vehicle preemption unit sending an optical signal toward the intersection. A head receives the optical signal and, once the optical signal has risen above a certain preset level, the head transmits a head identifier (i.e., the number of the head) and a notification that a vehicle is approaching the intersection to the intersection preemption unit. In response to receiving the notification, the intersection preemption unit transmits a radio signal that can be received by all vehicles in the area of the intersection. The radio signal includes a request that the vehicles transmit their identifier, a vehicle identification number, via a radio signal using the vehicle radio transceivers of their vehicle preemption units. Those vehicles transmitting optical signals to the intersection respond to the request by transmitting a radio signal containing their respective vehicle identification number. Once the intersection preemption unit has received the radio signals, it determines how many vehicles are approaching the intersection and then transmits a radio signal containing a timing signal. As each vehicle continues to transmit optical signals the time of transmission of each optical signal is recorded in a log using the time contained in the timing signal from the intersection preemption unit. The heads also record in a log the time they receive the optical signals relative to the time contained in the timing signal. At a predefined timing interval, the vehicles and heads transmit the recorded time logs to the intersection controller so that the intersection controller can identify the vehicles by matching the time entries of a vehicle log with the time entries from the log of a particular head. Using a knowledge of which head faces which direction, the intersection controller can then determine from which direction the vehicles are approaching.

In places where the description above refers to particular implementations of traffic preemption systems, it should be readily apparent that a number of modifications may be made without departing from the spirit thereof and that these implementations may be applied to other traffic preemption systems.

The invention claimed is:

1. A traffic preemption system comprising:

a vehicle preemption unit configured to mount to a vehicle, the vehicle preemption unit comprising an optical transmitter;

an intersection preemption unit coupled to an intersection system controller, the intersection preemption unit configured to receive an identification of a presence of a vehicle from the optical transmitter and a signal indicating a status of the vehicle and change a traffic light in favor of the vehicle to which the vehicle preemption unit is mounted in response to the signal indicating the status of the vehicle received from the vehicle preemption unit;

a vehicle radio transceiver configured to communicate with the intersection preemption unit; and a vehicle controller coupled to the optical transmitter and the vehicle radio receiver, the vehicle controller configured to generate a vehicle identifying characteristic unique to the vehicle, the vehicle identifying characteristic having a time delay unique to the vehicle, the time delay included in the signal received from the vehicle preemption unit.

2. The traffic preemption system of claim 1, wherein the intersection preemption unit further comprises a head mounted to a traffic light support fixture.

3. The traffic preemption system of claim 2, wherein the head comprises an optical receiver and an intersection radio transceiver.

4. The traffic preemption system of claim 2, wherein the head is coupled to the intersection system controller via a wireless relay.

5. The traffic preemption system of claim 1, wherein the signal received by the intersection preemption unit from the vehicle preemption unit is an optical signal.

6. The traffic preemption system of claim 1, wherein the signal received by the intersection preemption unit from the vehicle preemption unit is a radio signal.

7. The traffic preemption system of claim 1, wherein the signal received by the intersection preemption unit from the vehicle preemption unit is a combination of optical and radio signals.

8. A traffic preemption system comprising:

a vehicle preemption unit configured to mount to a vehicle, the vehicle preemption unit comprising an optical transmitter;

a first intersection preemption unit coupled to a first intersection system controller, the first intersection preemption unit configured to receive an identification of a presence of a vehicle from the optical transmitter and a signal indicating a status of the vehicle and change a first traffic light at a first intersection in favor of a vehicle to which the vehicle preemption unit is mounted;

a second intersection preemption unit coupled to a second intersection system controller, the second intersection preemption unit configured to receive a signal transmitted by the first intersection preemption unit in response to the first intersection preemption unit receiving the signal indicating the status of the vehicle, the second intersection preemption unit configured to change a second traffic light at a second intersection in favor of the vehicle to which the vehicle preemption unit is mounted.

9. The traffic preemption system of claim 8, wherein the signal transmitted by the first intersection preemption unit to the second intersection preemption unit is a radio signal.

10. The traffic preemption system of claim 8, wherein the second intersection preemption unit is located around a corner from the first intersection preemption unit.

11. The traffic preemption system of claim 8, wherein the signal indicating the status of the vehicle is generated in response to engaging a turn signal of the vehicle.

12. The traffic preemption system of claim 8, wherein the signal indicating the status of the vehicle is generated in response to a change in a speed at which the vehicle is traveling.

13. The traffic preemption system of claim 8, wherein the signal indicating the status of the vehicle is generated in response to information received from a wheel rotation sensor.

14. The traffic preemption system of claim 8, wherein the signal indicating the status of the vehicle is generated in response to information received from a brake sensor.

15. A method of assembling a traffic preemption system, the method comprising:

configuring a first intersection preemption unit to receive an identification of a presence of a vehicle from an optical transmitter and a signal indicating a status of a vehicle and change a first traffic light at a first intersection in favor of the vehicle;

configuring a vehicle preemption unit comprising an optical transmitter to mount to a vehicle;

coupling the first intersection preemption unit to a first intersection system controller;

configuring a second intersection preemption unit to receive a signal transmitted by the first intersection preemption unit in response to the first intersection preemption unit receiving the signal indicating the status of the vehicle and to change a second traffic light at a second intersection in favor of the vehicle; and coupling the second intersection preemption unit to a second system intersection controller.

16. The method of claim 15, further comprising configuring the first intersection preemption unit to transmit a radio signal to the second intersection preemption unit.

17. The method of claim 15, wherein the second intersection preemption unit is configured to be located around a corner from the first intersection preemption unit.

18. The method of claim 15, wherein the signal indicating the status of the vehicle is generated in response to engaging a turn signal of the vehicle.

19. The method of claim 15, wherein the signal indicating the status of the vehicle is generated in response to a change in a speed at which the vehicle is traveling.

20. The method of claim 15, wherein the signal indicating the status of the vehicle is generated in response to information received from a wheel rotation sensor.

21. The method of claim 15, wherein the signal indicating the status of the vehicle is generated in response to information received from a brake sensor.

* * * * *